US008786460B2

(12) United States Patent
Huang

(10) Patent No.: US 8,786,460 B2
(45) Date of Patent: Jul. 22, 2014

(54) MAGNETICALLY CONTROLLED WARNING LAMP

(76) Inventor: Chun-Ming Huang, Taichung (TW)

( * ) Notice: Subject to any disclaimer, the term of this patent is extended or adjusted under 35 U.S.C. 154(b) by 167 days.

(21) Appl. No.: 13/478,312

(22) Filed: May 23, 2012

(65) Prior Publication Data

US 2013/0314240 A1 Nov. 28, 2013

(51) Int. Cl.
*G08B 5/22* (2006.01)

(52) U.S. Cl.
USPC ..... 340/815.45; 340/332; 340/333

(58) Field of Classification Search
USPC ..... 340/815.45, 332, 333
See application file for complete search history.

(56) References Cited

U.S. PATENT DOCUMENTS

2005/0264472 A1* 12/2005 Rast ..... 345/30

* cited by examiner

*Primary Examiner* — Daryl Pope
(74) *Attorney, Agent, or Firm* — Birch, Stewart, Kolasch & Birch, LLP

(57) ABSTRACT

A magnetically controlled warning lamp has a light module and a circuit board mounted in the body. The circuit board has a magnetic device, a control module and a power module. The power module provides the control module and the light module with a working voltage. The magnetic device is activated to generate a trigger signal by a magnetic field. The control module changes the operation mode for the light module based on the trigger signal. A user can use a magnet to activate the magnetic device to easily change the operation mode for the light module instead of disassembling the warning lamp.

9 Claims, 5 Drawing Sheets

MAGNETICALLY CONTROLLED WARNING LAMP

BACKGROUND OF THE INVENTION

1. Field of the Invention

The present invention relates to a warning lamp, and more particularly to a magnetically controlled warning lamp.

2. Description of Related Art

A conventional warning lamp comprises a base, a circuit board, a light module and a cover.

The base has a hole.

The light module is mounted in the base.

The circuit board is mounted in the base and connects to the light module and an outer power source via a cable passing through the hole of the base. The circuit board has a socket, a jumper and a control module.

The socket has multiple pins.

The jumper is mounted on the socket and has an electrical pad. The electrical pad is applied to electrically connect to a part of the pins to form a certain combination of the pins. Different combinations of the pins respectively represent different trigger signals.

The control module is electrically connected to the light module and the socket. The control module changes the operation modes and the flashing frequencies for the light module based on the trigger signal of the socket.

The cover is mounted on the base to cover the light module and the circuit board.

For example, the operation mode can be a constant brightness mode, a rapid flash mode or a successive flash mode. The operation modes are adapted to different environments to attract people's attentions. Hence, the risks of accidents will be avoided.

When a user wants to change the operation mode for the light module, the user has to disassemble the warning lamp. The cover has to be removed to expose the socket at first. And then the position of the jumper has to be changed to vary the combination of the pins. Finally, the user mounts the cover on the base again. Hence, to manually change the operation modes for the conventional warning lamp is inconvenient.

SUMMARY OF THE INVENTION

An objective of the present invention is to provide a magnetically controlled warning lamp. The operation modes of the warning lamp in accordance with the present invention can be conveniently changed.

To achieve the foregoing objective, the magnetically controlled warning lamp comprises a body, a light module, and a circuit board.

The body has a space.

The light module is mounted in the space of the body and has at least one LED.

The circuit board is mounted in the space of the body and has a magnetic device, a control module and a power module.

The magnetic device generates a trigger signal in response to a magnetic field.

The control module provides multiple operation modes and is electrically connected to the light module and the magnetic device to activate the light module to be operated in one of the operation modes based on the trigger signal generated from the magnetic device.

The power module is electrically connected to the control module and the light module to provide a working voltage.

Based on the warning lamp in accordance with the present invention, a user can move a magnet to the magnetic device.

The magnetic device will be activated by the magnetic field of the magnet to generate the trigger signal. When the control module receives the trigger signal, the control module changes the operation mode for the light module. To disassemble the warning lamp in accordance with the present invention to change the operation mode is unnecessary. The warning lamp in accordance with the present invention is more convenient to use.

DETAILED DESCRIPTION OF THE PREFERRED EMBODIMENT

Figure 1:
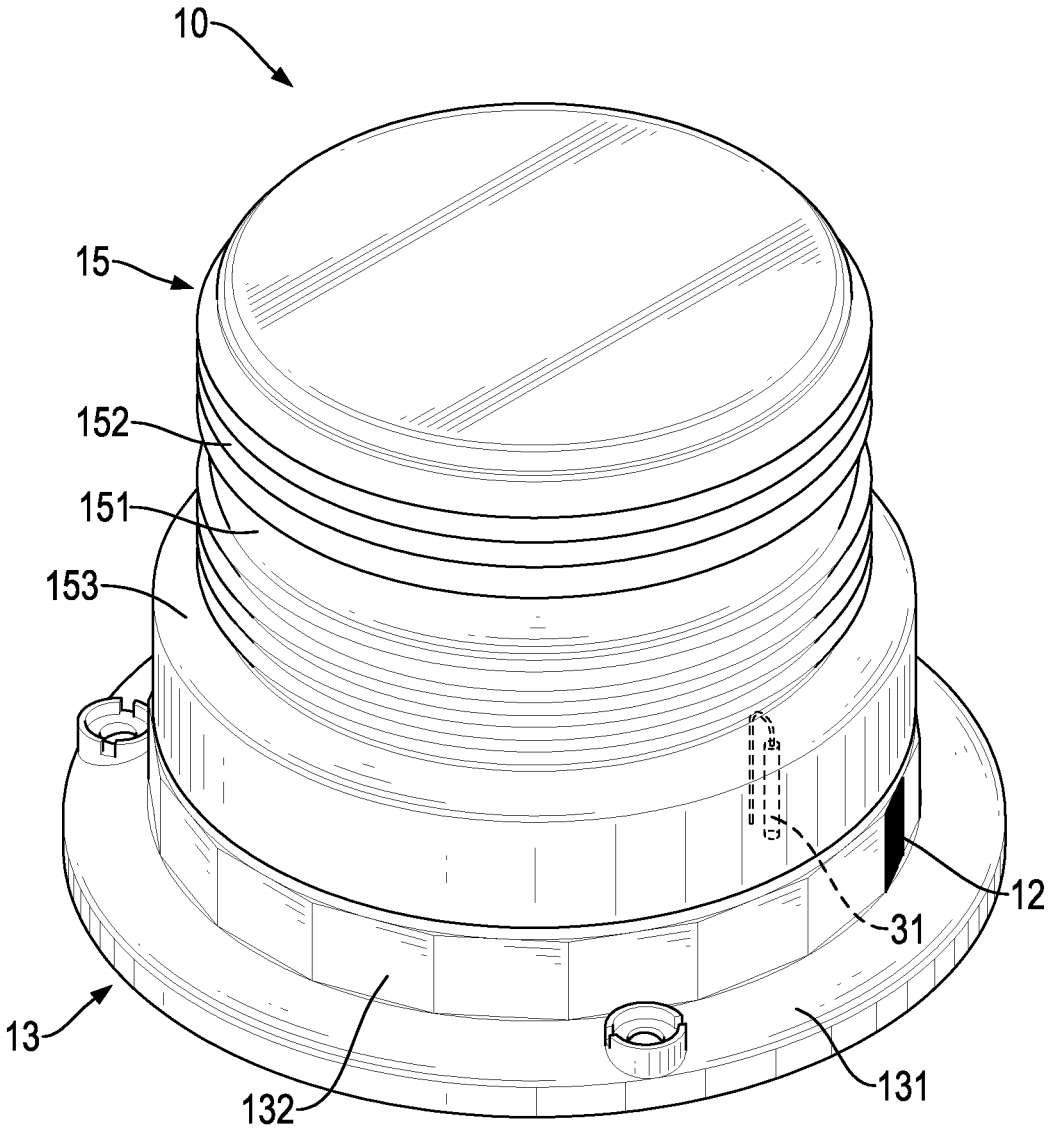
FIG. 1 is a perspective view of a first embodiment in accordance with the present invention.
Figure 2:
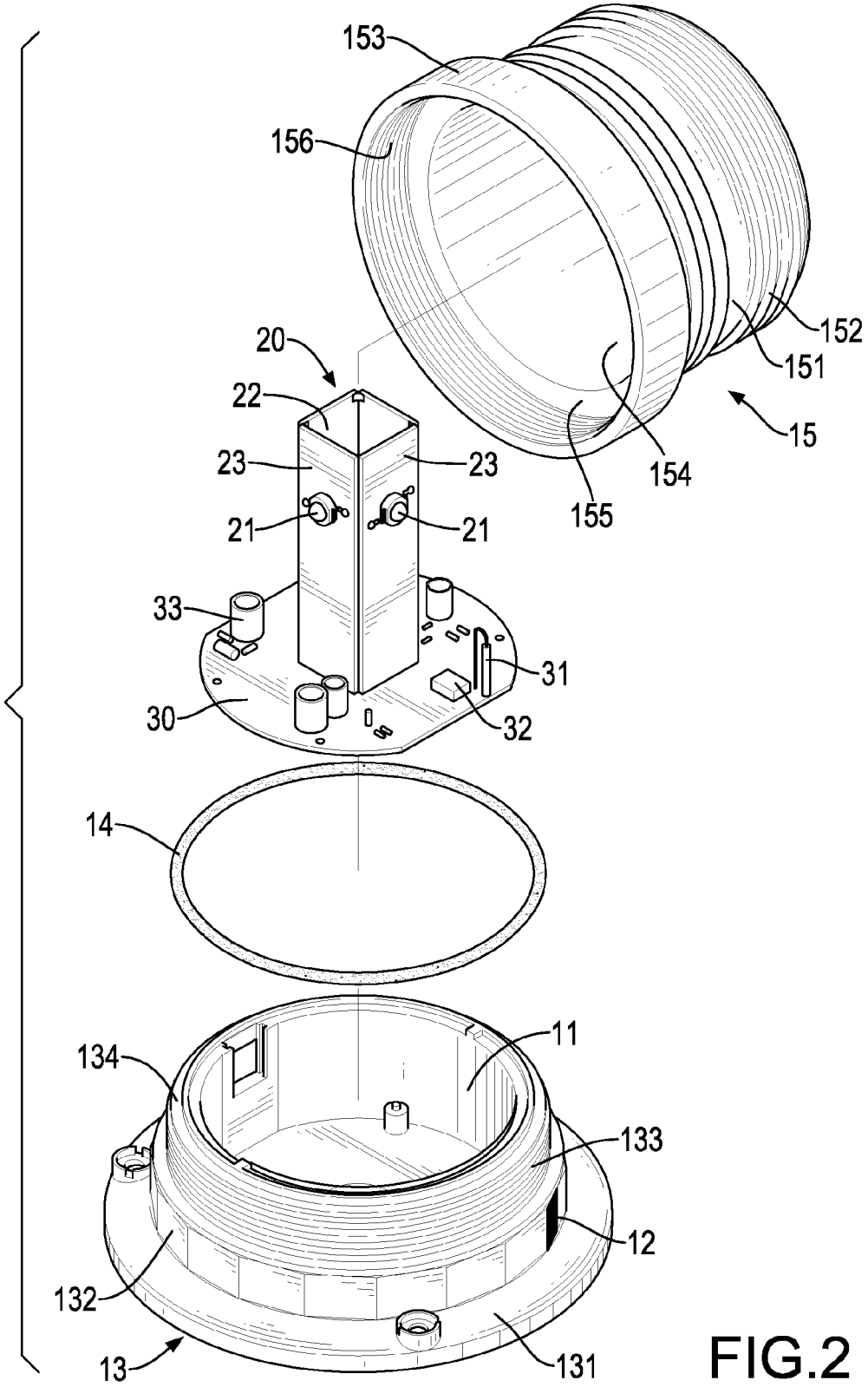
FIG. 2 is an exploded perspective view of the first embodiment in accordance with the present invention.

With reference to FIG. 1 and FIG. 2, a first embodiment in accordance with the present invention comprises a body 10, a light module 20 and a circuit board 30.

The body 10 has a space 11 and an indication label 12. In the present invention, the body 10 has a base 13, a gasket 14 and a cover 15.

The base 13 has a substrate 131 and a circular wall 132. The substrate 131 has a top surface. The circular wall 132 protrudes from the top surface of the substrate 131 and has an inner surface, an outer surface, a top surface, an outer thread 133, a groove 134 and the indication label 12. The outer thread 133 is formed on the outer surface of the circular wall 132. The indication label 12 is formed on the outer surface of the circular wall 132 near the substrate 131. The groove 134 is formed in the top surface of the circular wall 132.

The gasket 14 is mounted in the groove 134 of the circular wall 132.

Figure 5:
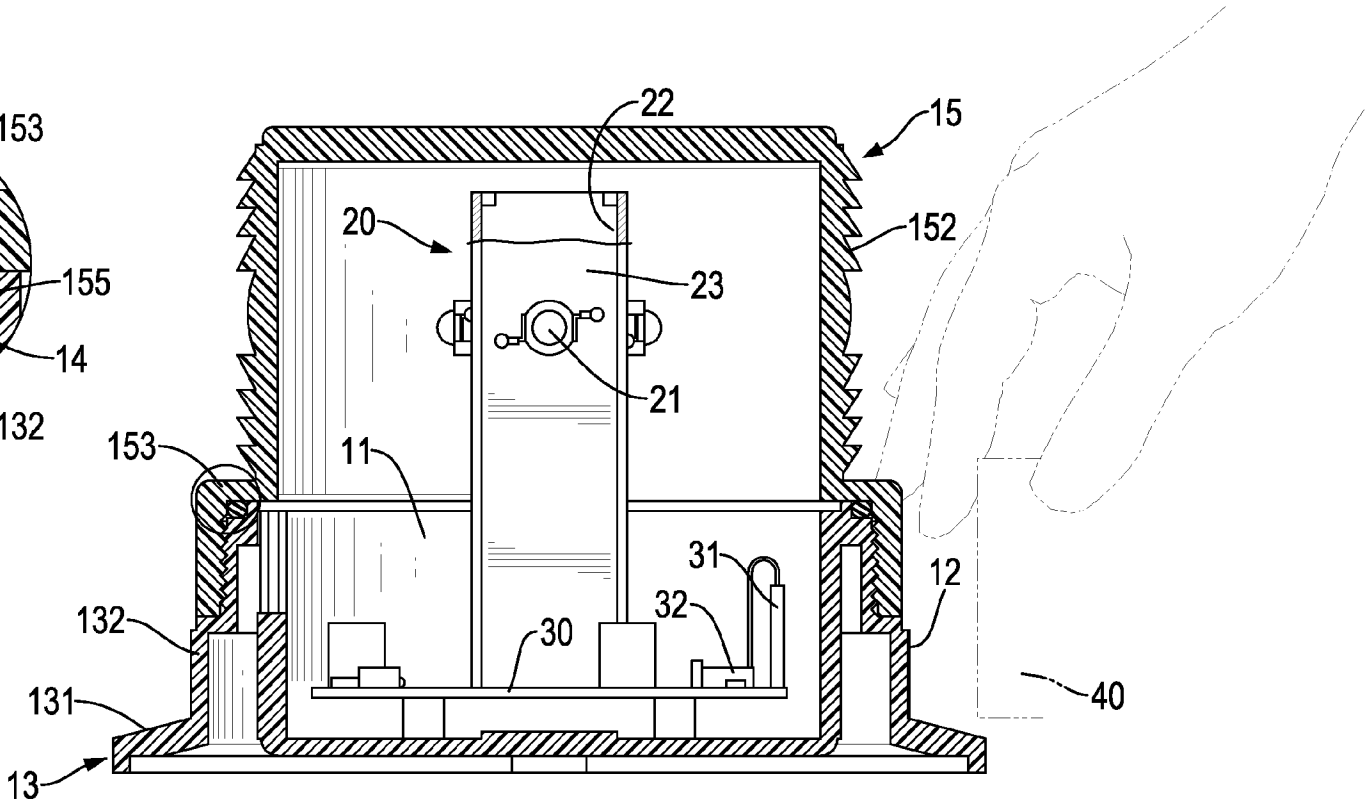
FIG. 5 is a cross-sectional view of the first embodiment in accordance with the present invention.
Figure 6:
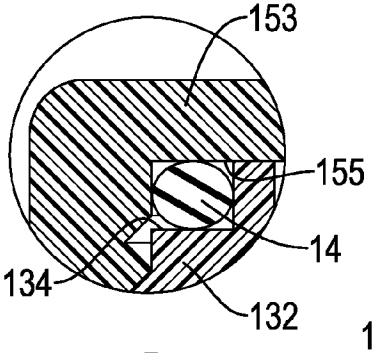
FIG. 6 is an enlarged cross sectional view showing that the gasket is pressed between the base and the cover.

The cover 15 is mounted on the base 13 and has an outer surface 151, multiple light guiding rings 152, an expansion terminal 153 with an expansion opening 154 and a blocking surface 155. The light guiding rings 152 are axially formed on the outer surface 151 of the cover 15. The blocking surface 155 is formed within the expansion opening 154. With reference to FIG. 5 and FIG. 6, when the cover 15 is attached to the base 13, the space 11 is defined between the base 13 and the cover 15 and the blocking surface 155 presses the gasket 14. In the present embodiment, the expansion terminal 153 of the cover 15 has an inner thread 156 securely screwed on the outer thread 133 of the circular wall 132. The gasket 14 is used to prevent outer moisture from permeating into the space 11.

The light module 20 is mounted in the space 11. The light module 20 has at least one light emitting diode (LED) 21 mounted above the circular wall 132. Furthermore, when the LED 21 emits light, the light guiding rings 152 uniformly spread the light emitted from the LED 21. In the present embodiment, the light module 20 has four LEDs 21 and a rectangular pillar 22 with four surfaces 23. The four LEDs 21 are respectively mounted on the surfaces 23.

The circuit board 30 is mounted in the space 11 and has a magnetic device 31, a control module 32 and a power module 33.

The magnetic device 31 is placed beside the indication label 12 of the circular wall 132 and activated to generate a trigger signal in response to an outer magnetic field. In the present invention, the magnetic device 31 is a magnetic reed switch. The magnetic reed switch has two conductors isolated from each other. If the magnetic reed switch detects the outer magnetic field, one of the conductors will be pushed or attracted by the outer magnetic field to electrically connect to the other conductor. The electrical connection can generate the trigger signal.

The control module 32 is electrically connected to the light module 20 and the magnetic device 31. The control module 32 provides multiple operation modes for the light module 20. The control module 32 sequentially changes the operation modes when the trigger signal is generated from the magnetic device 31. For example, the operating mode can be a constant brightness mode, a rapid flash mode, a successive flash mode or a gradual adjusting mode.

The power module 33 is electrically connected to the control module 32 and the light module 20 to provide a working voltage. The power module 33 converts an outer power source to the working voltage. The outer power source can be a DC power source or an AC power source.

Figure 3:
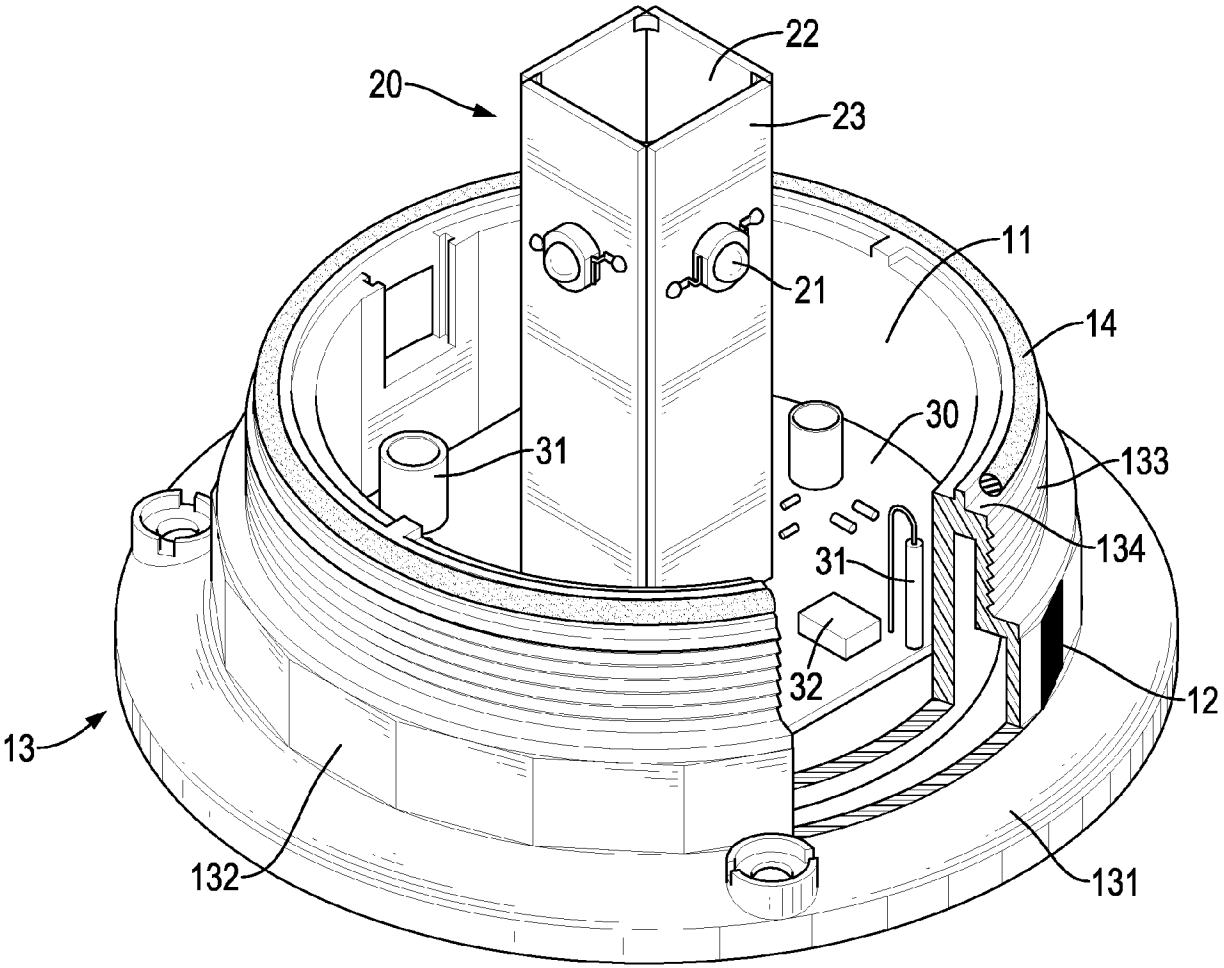
FIG. 3 is a partially cross-sectional view of the first embodiment in accordance with the present invention.
Figure 4:
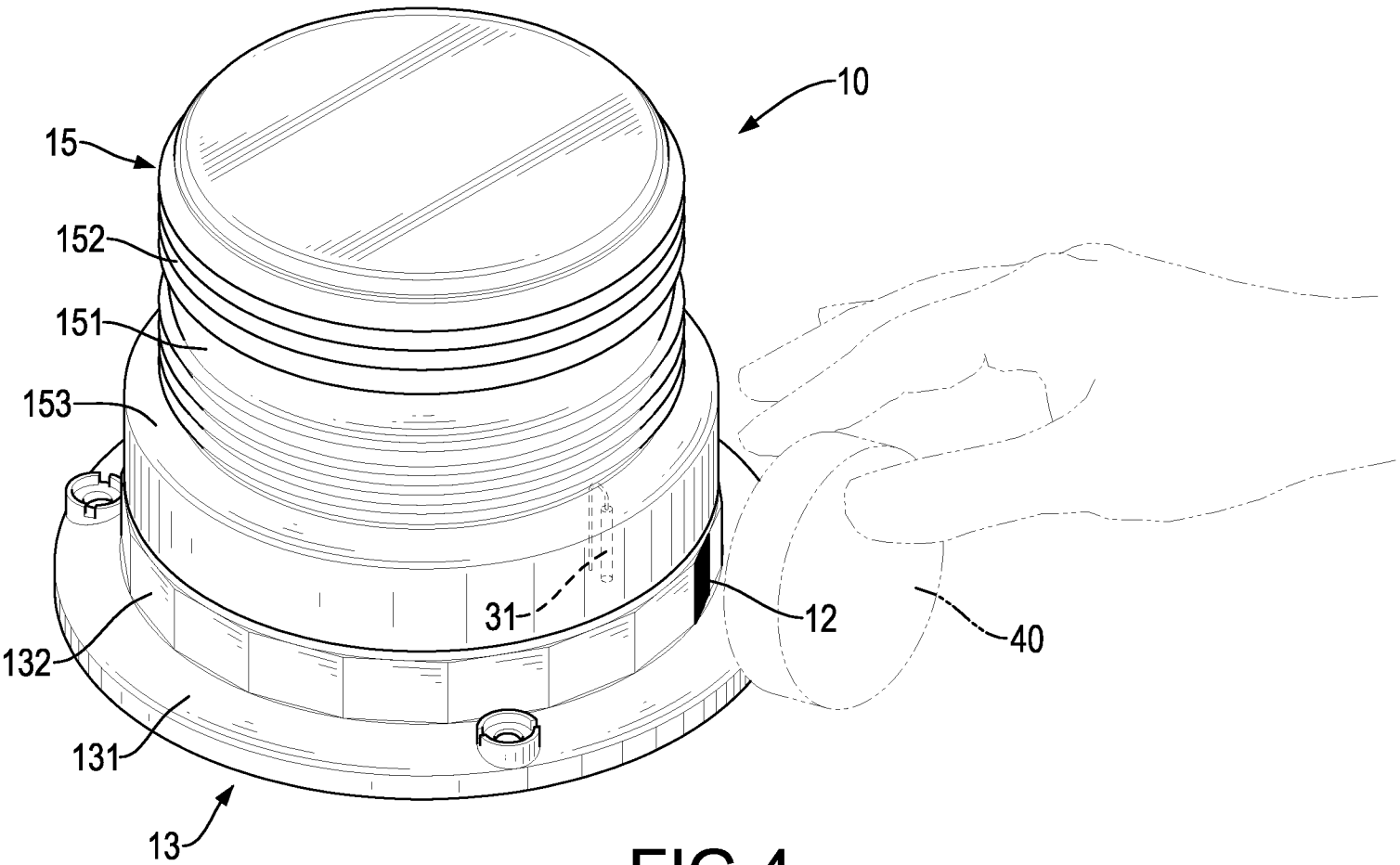
FIG. 4 is an operating view of the first embodiment in accordance with the present invention.

With reference to FIG. 3, the indication label 12 indicates the position of the magnetic device 31. With reference to FIG. 4 and FIG. 5, if a magnet 40 approaches the indication label 12, the magnetic device 31 will detect the magnetic field of the magnet 40 and then generate the trigger signal. When the control module 32 receives the trigger signal, the control module 32 changes the operation mode for the light module 20.

Above all, instead of disassembling a conventional warning lamp to change the operation mode for the light module, changing the operation modes by moving an external magnet 40 to the indication label 12 outside is easier and more convenient. In addition, the magnetic device 31, the control module 32 and the power module 33 can be packaged in a waterproof film. Moisture hardly permeates into the circuit board to damage the magnetic device 31, the control module 32 and the power module 33. Hence, the waterproof effect of the warning lamp in accordance with the present invention is improved.

What is claimed is:

1. A magnetically controlled warning lamp comprising:
- a body having:
  - a base having:
    - a substrate having a top surface; and
    - a circular wall protruding from the top surface of the substrate and having:
      - an outer surface; and
      - an outer thread formed on the outer surface; and
    - a cover having an expansion terminal with an inner thread securely screwed on the outer thread of the circular wall, wherein a space is defined between the base and the cover when the cover is attached to the base;
  - a light module mounted in the space of the body and having at least one LED; and
  - a circuit board mounted in the space of the body and having:
    - a magnetic device generating a trigger signal in response to a magnetic field;
    - a control module providing multiple operation modes and electrically connected to the light module and the magnetic device to activate the light module to be operated in one of the operation modes based on the trigger signal; and
    - a power module electrically connected to the control module and the light module to provide a working voltage.

2. The warning lamp as claimed in claim 1 further comprising a gasket, wherein:
- the circular wall has a top surface and a groove formed in the top surface of the circular wall;
- the gasket is mounted in the groove; and
- the expansion terminal of the cover has a blocking surface that presses against the gasket when the cover is attached to the base.

3. The warning lamp as claimed in claim 2, wherein the cover has an outer surface and multiple light guiding rings axially formed on the outer surface of the cover.

4. The warning lamp as claimed in claim 1 further comprising an indication label formed on the outer surface of the circular wall and beside the magnetic device.

5. The warning lamp as claimed in claim 2 further comprising an indication label formed on the outer surface of the circular wall and beside the magnetic device.

6. The warning lamp as claimed in claim 3 further comprising an indication label formed on the outer surface of the circular wall and beside the magnetic device.

7. The warning lamp as claimed in claim 4, wherein the light module comprises:
- a rectangular pillar with four surfaces; and
- four LEDs respectively mounted on the surfaces and above the circular wall.

8. The warning lamp as claimed in claim 5, wherein the light module comprises:
- a rectangular pillar with four surfaces; and
- four LEDs respectively mounted on the surfaces and above the circular wall.

9. The warning lamp as claimed in claim 6, wherein the light module comprises:
- a rectangular pillar with four surfaces; and
- four LEDs respectively mounted on the surfaces and above the circular wall.

* * * * *